United States Patent [19]

Gambale et al.

[11] Patent Number: 4,951,654

[45] Date of Patent: Aug. 28, 1990

[54] TRACTION TABLE

[76] Inventors: Anthony G. Gambale, 11 Stratford Ave., Avon, Mass. 02322; Dwight J. DeGeorge, 10 Kings Rd., Lynnfield, Mass. 01024

[21] Appl. No.: 383,407

[22] Filed: Jul. 24, 1989

[51] Int. Cl.[5] ..... A61H 1/02

[52] U.S. Cl. ..... 128/75; 128/72; 128/76 R

[58] Field of Search ..... 128/75, 76 R, 70–74

[56] References Cited

U.S. PATENT DOCUMENTS

| | | | |
|---|---|---|---|
| 1,117,403 | 11/1914 | Kreitzer . | |
| 2,088,747 | 8/1937 | Kelley | 128/75 |
| 2,191,097 | 2/1940 | Morrison . | |
| 2,553,969 | 5/1951 | Hien et al. | 128/75 |
| 2,633,125 | 3/1953 | Yellin | 128/75 |
| 2,640,480 | 6/1953 | Hill | 128/57 |
| 2,703,080 | 3/1955 | Sanders | 128/25 |
| 2,893,384 | 7/1959 | Chick | 128/75 |
| 3,033,198 | 5/1962 | Jensen | 128/75 |
| 3,081,085 | 3/1963 | Girolams | 128/71 |
| 3,359,976 | 12/1967 | Laval | 128/75 |
| 3,403,675 | 10/1968 | Carr | 128/75 |
| 3,709,217 | 1/1973 | Powers | 128/75 |
| 3,771,518 | 11/1973 | Greissing | 128/71 |
| 3,821,953 | 7/1974 | Mikan | 128/71 |
| 3,856,003 | 12/1974 | Pfluger | 128/75 |
| 3,871,366 | 3/1975 | Cotrel | 128/75 |
| 4,356,816 | 11/1982 | Granberg | 128/71 |
| 4,593,684 | 6/1986 | Graham | 128/75 |
| 4,602,619 | 7/1986 | Wolf et al. | 128/75 |
| 4,686,968 | 8/1987 | Scherger | 128/72 |
| 4,802,465 | 2/1989 | Slagle | 128/71 |

FOREIGN PATENT DOCUMENTS

| | | | |
|---|---|---|---|
| 2524800 | 10/1983 | France | 128/75 |

*Primary Examiner*—Richard J. Apley
*Assistant Examiner*—Joe H. Cheng
*Attorney, Agent, or Firm*—Kenway & Crowley

[57] ABSTRACT

Method and apparatus including a spinal extension traction table is provided for directing the spine of a person toward optimum shape and alignment, which table has a support surface for supporting the buttocks of a person and an inclined surface for supporting his back thereon, so that his head extends thereover and inclines backwardly. A forehead sling is mounted on an upper portion of the traction table with pull means connected thereto so as to pull the sling against the forehead of the person, to apply compressive forces thereto at an acute angle with at least one upper spine of the person so as to apply extension traction to his spine. In another embodiment, a lateral (posterior to anterior) force is applied to a lower portion of the person's spine toward aligning the cervical spine over the lumbar spine, with the thoracic (or dorsal) spine forming a desired curve therebetween, when the person stands or walks. Preferably the lateral force is provided by a fulcrum cushion. Desirably the support surface of the traction table is sized to permit the lower legs and feet of the person to extend toward a floor surface, to apply counterweight tension to the forehead compressive forces.

11 Claims, 5 Drawing Sheets

TRACTION TABLE

BACKGROUND OF THE INVENTION

1. Field of the Invention

This invention relates to method and apparatus for correcting a person's spine, particularly for directing a person's spine toward a desired shape.

2. The Prior Art

Previously for back and neck problems, chiropractors and other practitioners have applied flexion traction to the cervical spine i.e. have tractioned or stretched the upper or neck portion of a patient's spine, including stretching ligaments or muscles thereat. The patient could be sitting, standing or lying down and subjected to a pulling or stretching force e.g. as by a harness around the patient's chin and the pulling force applied thereto. See for examples, U.S. Pat. No. 2,640,480 (1953) and U.S. Pat. No. 4,356,816 (1982) mentioned below. This approach however, merely stretches and flattens the spinal curve, as seen in a side x-ray view of the patient i.e. flattens and/or distorts the desired spinal curve that nature intended. Thus at the present time there is believed no traction method or apparatus aimed at restoring this spine to an improved or optimum shape and position and/or side view curve and there is a need and market therefor.

Accordingly, there has now been discovered a method and apparatus for improving or correcting spinal difficulties of a person, in which a person's spinal curve is directed toward a position and/or shape that nature intended, to support man's carriage e.g. in the upright position.

Broadly the present invention provides method and apparatus for directing a person's spine toward an improved and/or optimum shape comprising, reclining said person, so that at least his upper back is supported on an inclined surface with his head inclined further backwardly and applying compressive forces to the forehead of said person at an acute angle with the upper spine of said person, to apply extension traction and spine curvature forces to at least the upper spine of said person.

Also the method and apparatus of the invention further provide for applying a lateral (posterior to anterior) force to a lower portion of the spine, e.g. by positioning a fulcrum cushion between a lower portion of said back and such inclined surface with or without application of the above compressive forces, to further direct the spine of such person toward improved curvature thereof.

By "an optimum spinal shape" as used herein, is meant any one of the spinal configurations as defined in D. D. Harrison's "Chiropractic Physics of Spinal Correction", C.P.B., Vol. 4 (1988).

By '37 lateral force" as used herein, is meant a posterior to anterior force (applied to a person's spine).

BRIEF DESCRIPTION OF THE DRAWING

The invention will become more apparent from the following detailed Specification and drawings in which.

DESCRIPTION OF PREFERRED EMBODIMENT

Figure 1:
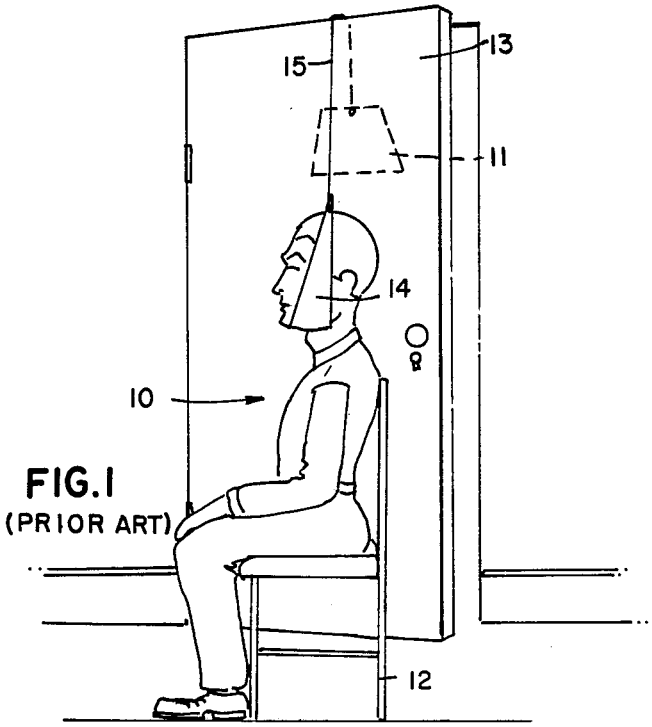
FIG.1 (PRIOR ART)
FIG. 1 is an elevation view of a device of the prior art.

Referring in more detail to the drawings, according to the prior art, to relieve the aches and pains of a person in his neck region, the person 10 is placed in a chair 12 with his neck and cervical spine stretched by chin sling 14, cord 15 and weight 17 over door 19, as shown in FIG. 1. This crude tensioning method does not position the spine in the optimum position, e.g. shown in FIG. 4, and does not give significant relief to the person. Other examples of neck and spine tensioning or stretching are shown in the prior art e.g. in U.S. Pat. No. 2,640,480 (1953) and U.S. Pat. No. 4,356,816 (1982). In neither reference is attention paid to shaping the spine into the optimum position i.e. along the lines nature intended.

Figure 2:
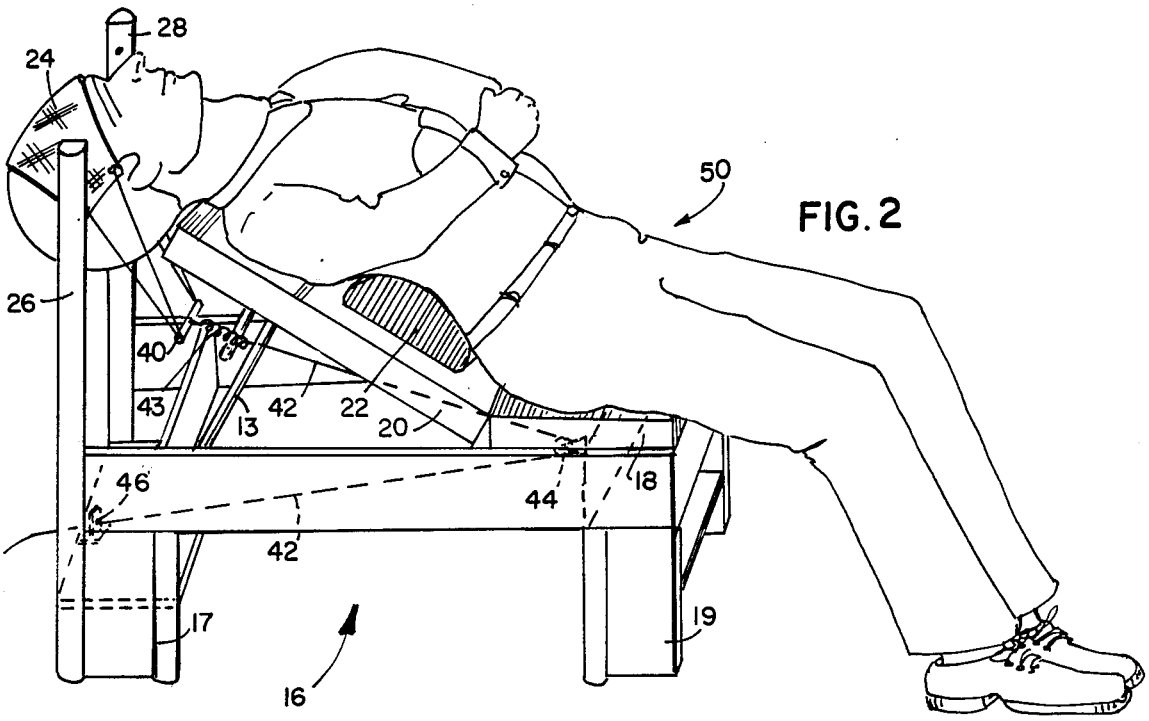
FIG. 2 is a side elevation view of a traction table embodying the present invention.
Figure 3:
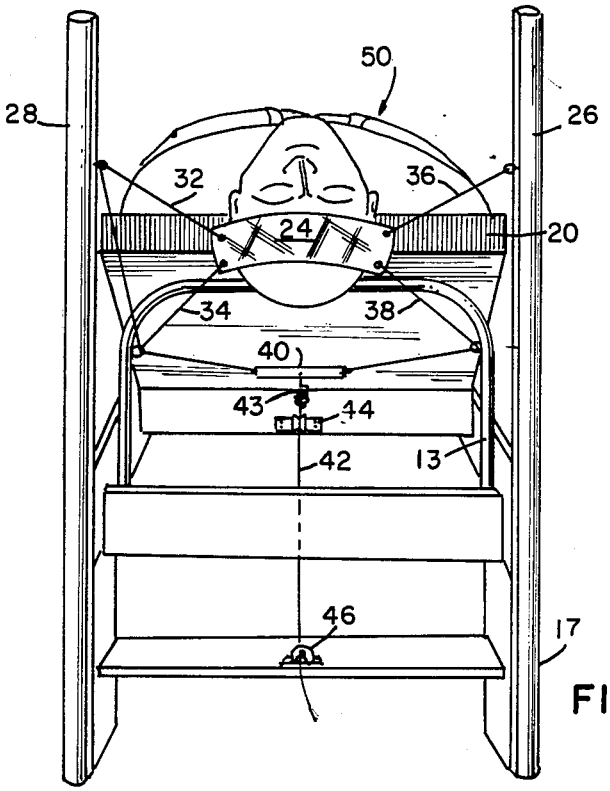
FIG. 3 is an end elevation view of the traction table embodiment shown in FIG. 2.

To correct this problem, the present invention provides a spinal traction table in which the table 16, having legs 17 and 19, as shown in FIG. 2, has a support surface, e.g. a seat 18 and inclined surface or ramp 20, on which is placed a removable fulcrum cushion 22 and a forehead sling 24, mounted between two table leg uprights 26 and 28, as shown in FIGS. 2 and 3. The forehead sling 24 is connected by lines 32, 34, 36 and 38 to relatively rigid yoke 40, which is in turn connected by pull cord 42, through tension spring 43, through pulley 44 and through jam cleat 46, to control the tension applied to the pull cord 42 and the pressure applied by the forehead sling 24 to the person's forehead, as shown in FIGS. 2 and 3.

Figure 4:
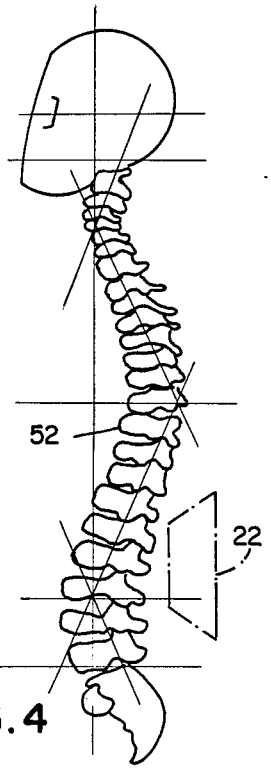
FIG. 4 is a side elevation view of a person's spine.
Figure 5:
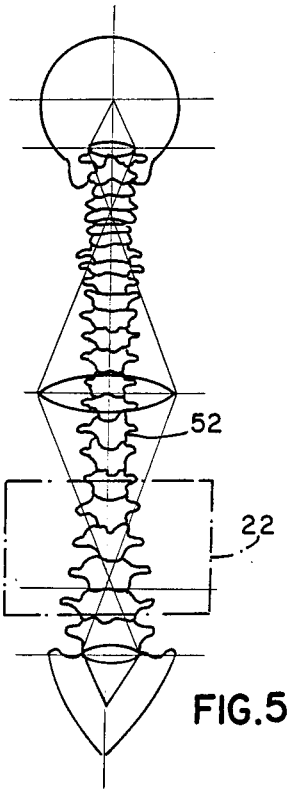
FIG. 5 is a front elevation view of a person's spine.

With the person (or patient) 50 in position on the table 16, the lower back fulcrum cushion 22 and the forehead sling 24 are adjusted, as to size and position for the cushion 22 and as to pressure applied by the sling 24, to correct the patient's spine 52 toward the optimum position, as shown in FIG. 4, which after repeated treatments can serve to correct various spinal problems. That is, the traction table of the invention, upon repeated treatments, can reshape the person's spine by restoring para spinal soft tissues (e.g. muscles and ligaments) to optimum condition and position, to thus restore proper shape, function and health to the spine. An outline of the cushion 22 is shown in FIG. 4, to show where its corrective shaping force is applied to the lower spine of the person. As indicated in FIG. 4, the idea is to have the cervical portion of the spine aligned with the lumbar portion of the spine with the thoracic (dorsal) or middle spine portion curving at a desired angle, as indicated in FIG. 4. From the frontal view shown in FIG. 5, the spine 52 should appear straight, but not from the side view, as shown in FIG. 4.

Figure 6:
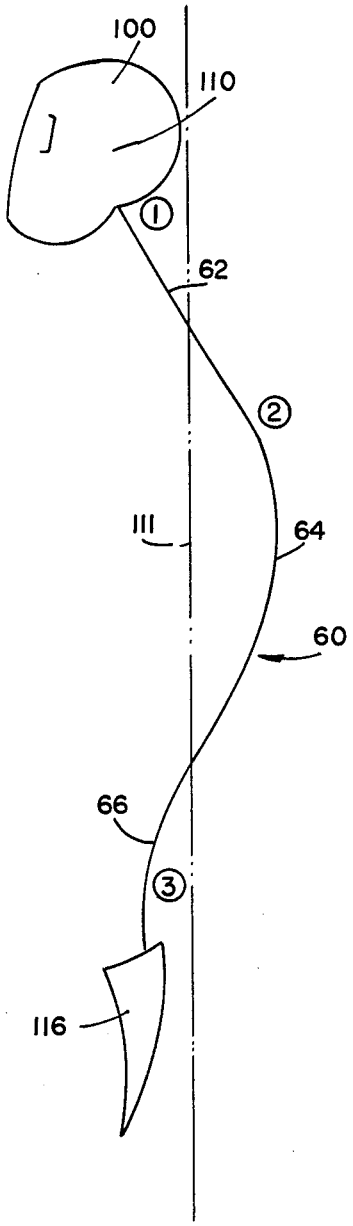
FIG. 6 is a schematic elevation view of a distorted spine shape.

Thus, for example, if it is desired to correct the malformed spine 60 shown in FIG. 6, which is misshappen at cervical spine 62, thoracic spine 64 and lumbar spine 66, one commences treatment by placing the person 68

Figure 7:
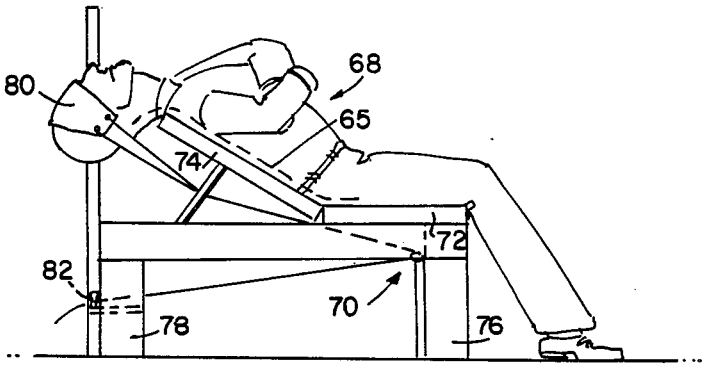
FIGS. 7, 8 and 9 are schematic elevation views of corrective measures applied to a person's spine according to the present invention.

(who likely will not have all of the above disorders) on traction table 70, as shown in FIG. 7. The traction table 70 has flat support surface 72, inclined surface or ramp 74, leg supports 76 and 78 and forehead compression sling 80, as shown in FIG. 7. Initially the person 68, having spine 65, is positioned on his back on the table 70, with his back supported by the inclined surface portion 74, with head and neck inclined backwardly, as discussed previously and with compressive force applied to the forehead by sling 80 through a jam cleat 82, mounted on the table 70 as shown in FIG. 7.

Figure 8:
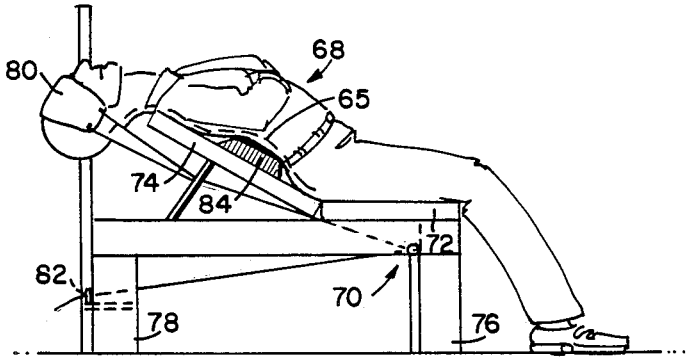

After one or more treatments sessions to apply corrective forces to the cervical spine, a fulcrum cushion 84 can be placed between the person's back (e.g. at a subsequent treatment session) to apply corrective (posterior to anterior) alignment forces to the thoracic spine of the person 68 as shown in FIG. 8.

Figure 9:
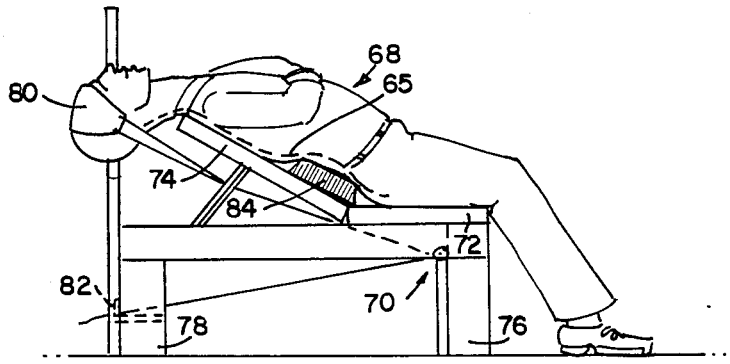

Subsequently that fulcrum cushion or another, e.g. of a shape selected by a chiropractor, at e.g. a subsequent treatment session, can be inserted between the inclined surface of the traction table 70 and a lower portion of the back of the person 68, as shown in FIG. 9, to apply corrective shaping forces to the lumbar spine of the person 68, per FIGS. 9 and 6.

Figure 14:
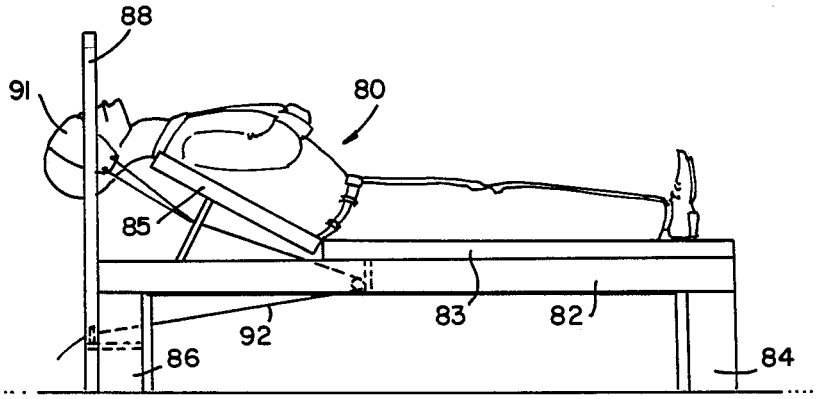
FIG. 14 is a side elevation view of another traction table embodying the present invention.

In another embodiment of the invention, extended traction table 82 has level support surface 83 and inclined surface 85 supported by table legs 84 and 86, as shown in FIG. 14. The person 80 lies on the table 82, with his back on the inclined surface 85 and his head back. A forehead sling 91, supported by the uprights 88 of the table legs 86, applies compressive (extension) forces to the person's forehead by tensioning pull cord 92 attached to such sling 91, as shown in FIG. 14. Here the lower legs and feet are also on the support surface 83 of the table 82. However, a fulcrum cushion can be placed between the person's back and the inclined surface 85, if desired, within the scope of the present invention.

Figure 10:
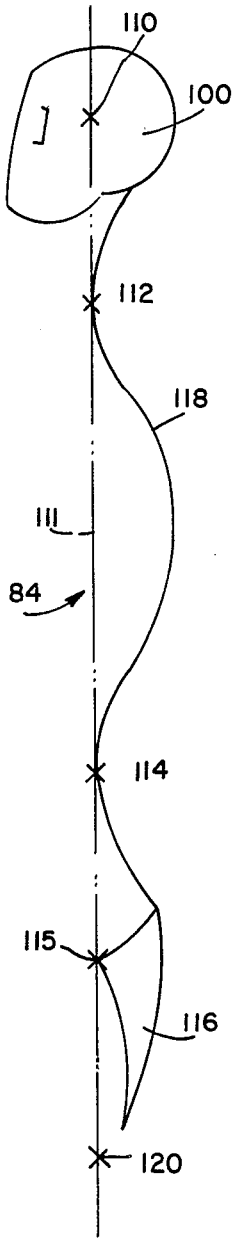
FIG. 10 is a schematic elevation view of a corrected or ideal spine of a person.

Thus according to the method of the above invention, by applying via the forehead, compressive extension forces to the cervical spine and by reshaping the thoracic and lumbar spines with fulcrum cushions as discussed above, one can reshape a malformed spine toward an ideal or optimum spine shape such as the spine 84, shown in FIG. 10. Ideally, the centers of mass of the head, thoracic cage and pelvis are aligned on a vertical axis. That is, in an optimum spine shape, when a person is standing or walking, the center of mass 110 of his head 100 is aligned on the vertical axis 111 with the fifth cervical vertebrae 112 and with the third lumbar vertebrae 114 and also with the anterior tip 115 of the sacrum 116, with the thoracic spine 118 curving rearwardly of such vertical axis 111, as shown in FIG. 10. The sacrum is attached to the femur heads below, e.g. femur head 120, shown in FIG. 10.

The spinal traction table of the present invention is desirably sized to permit the person's legs to bend at the knee and extend toward the floor, which lower legs thus act as a counterweight to the compressive extension forces applied to the person's forehead which tends to pull the person's back upwardly along the inclined surface. However, as previously indicated, the spinal traction table on the invention can extend a sufficient length to hold the person's legs and feet off the floor and at various angles as desired within the scope of the present invention.

The fulcrum cushion can be hard, firm, soft or in-between, within the scope of the invention. Preferably, however, the cushion is firm enough to apply sufficient lateral (posterior to anterior) pressure for spinal reshaping purposes according to the needs of the person treated. For example, a 125-pound woman might require a firm fulcrum cushion for spinal-shape corrective purposes, whereas a heavier person, e.g. a 250-pound man, might require a very firm fulcrum cushion for spinal-shape corrective purposes. Alternatively, a person may wish to begin treatment with a relatively soft or firm fulcrum cushion and progress to a firmer one, as his back becomes accustomed to the lateral spine shaping forces of the fulcrum cushion, within the scope of the invention.

Figure 11:
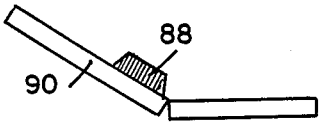
FIGS. 11, 12 and 13 are elevation views of components of the present invention
Figure 12:
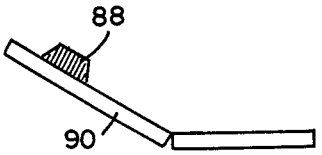
Figure 13:
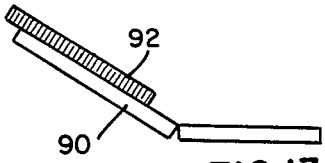

The fulcrum cushions can take various shapes (and degrees of firmness) depending upon the amount of force desired to be applied to a point on the person's back i.e. between the back and the inclined surface. Likewise the location of the cushion will be governed by the same considerations. Thus a fulcrum cushion 88 can be positioned on the inclined surface 90 in the lower and upper positions shown in FIGS. 11 and 12, while a cushion 92 of flat profile could alternatively be placed on the inclined surface 90 as shown in FIG. 13. Thus various shaped cushions in various locations on the inclined surface are used to impart the desired corrective force to a portion of the spine within the scope of the present invention.

The inclined surface of the traction table of the invention is adjustable and can be positioned at various angles with the level surface thereof, as desired within the scope of the invention.

The forehead sling or harness can likewise be supported on (or near) the spinal traction table of the invention by any desired method, provided it fits around the person's forehead for adjustment to any desired compressive force against forehead and cervical spine, as desired within the scope of the present invention. As indicated above, the forehead harness can be connected to a pull cord which passes through a jam cleat for adjustable and releasable tensioning purposes. Also, as shown e.g. in FIGS. 2 and 7, the pull cord passes proximate the inclined surface of the table so as to apply compressive force to the forehead of a person at an acute angle with at least the upper spine of the person.

Thus the method and apparatus of the present invention apply extension traction to the spine of a person to restore optimum curves thereof and realigns the center of masses of the spine one over the other, as indicated in FIG. 4. Or at least, the invention applies corrective forces to the spine in that direction. In other words, the method and apparatus of the invention apply corrective forces to (a) toward restoring the optimum lordosis of the cervical and lumbar spine, (b) toward restoring the optimum kyphosis in the thoracic spine, and (c) seeks to align the head, thoraces and pelvis to balance one over the other when a person is standing or walking, as nature intended, for improved health and well-being of person.

Thus the method and apparatus of the invention apply sling compression forces to the forehead and cervical spine at an acute angle thereto, toward correcting the curve of the cervical spine. In addition, if desired, the invention also can employ a fulcrum cushion between the inclined surface and the back of a person, to apply corrective shaping forces to other parts of the spine. Further the invention can direct the lower legs toward the floor in counterweight tension to the upper back forces thus applied.

What is claimed is:

1. An extension traction table for directing the spine of a person toward an optimum shape and alignment comprising a horizontal support surface for supporting the buttocks of the person, one end of a backwardly inclined surface connected to and disposed at an angle to said horizontal support surface for supporting the back of said person at an acute angle to said horizontal support surface, said inclined surface being of a length permitting the head of said person to extend beyond the other end thereof, means for positioning at least one fulcrum cushion between the selected points on said inclined surface and the back of said person, a forehead sling disposed above said person and the extension traction table, means connected between said forehead sling and said table for pulling said sling substantially in the direction of said buttocks, whereby compressive extension force are applied to the forehead of said person and extension traction is applied to the spine of said person, and means for adjustably positioning fulcrum cushion whereby a predetermined curve may be imparted to said spine of said person.

2. A traction table as defined in claim 1 whereby said pulling means comprises a spring-loaded pull cord connecting said sling to a portion of said table substantially beneath said person.

3. The traction table of claim 2 further including means for adjusting tension in said spring loaded pull cord.

4. The traction table of claim 3 wherein said horizontal support surface is disposed at a height sufficient to permit the lower legs and feet of the person supported thereon to extend angularly downward to serve as a counterweight to the compressive extension forces.

5. The traction table of claim 4, further including means for adjustably setting the angle of said inclined surface to said horizontal surface.

6. A method for directing a person's spine toward an optimum shape comprising the steps of reclining the person backwardly with the spine at a first angle to the vertical, reclining the head of the person further backwardly at a second angle greater than said first angle to the vertical, and applying compressive extension forces to the forehead of said person at an acute angle to the spine of said person to exert extension traction on said spine.

7. The method of claim 6 further comprising the step of resting the buttocks of said person on a horizontally disposed support surface during the application of said compressive extension forces.

8. The method of claim 6 including the further step of inserting a first fulcrum cushion between an inclined surface and the thoracic portion of said spine to apply posterior-to-anterior force thereto.

9. The method of claim 8 further including the steps of applying corrective forces thereto tending to restore optimum kyphosis in the thoracic spine.

10. The method of claim 6 including the further step of inserting a second fulcrum cushion between an inclined surface and the lumbar portion of said spine to apply posterior-to-anterior force thereto.

11. The method of claim 10 further including the steps of applying corrective forces thereto tending to restore the optimum lordosis in the cervical and lumbar spine.

* * * * *